US005992480A

United States Patent [19]

Hussain

[11] Patent Number: 5,992,480

[45] Date of Patent: Nov. 30, 1999

[54] VAPOR RECOVERY SYSTEM

[76] Inventor: Munawer Hussain, 451 S. Harvard Blvd. #233, Los Angeles, Calif. 90020

[21] Appl. No.: 09/063,960

[22] Filed: Apr. 21, 1998

[51] Int. Cl.[6] ..... B65B 1/04

[52] U.S. Cl. ..... 141/290; 141/45; 141/93; 222/109

[58] Field of Search ..... 141/290, 59, 44, 141/45, 93; 222/71, 75, 109

[56] References Cited

U.S. PATENT DOCUMENTS

| | | | |
|---|---|---|---|
| 3,756,291 | 9/1973 | McGahey et al. | 141/290 |
| 3,826,291 | 7/1974 | Steffens | 141/290 |
| 5,299,605 | 4/1994 | Bergamini et al. | 141/59 |

*Primary Examiner*—Steven O. Douglas

[57] ABSTRACT

A Vapor Recovery System for recovering gasoline vapors released into the vicinity of an automotive filing installation. The inventive device includes an closed-ended pipe having a plurality of apertures formed therealong disposed in spaced relationship to a pumping column front portion, a first sealed housing sealingly attachable to the closed-ended pipe, the first sealed housing further comprising a motor and fan assembly disposed therein, a second sealed housing sealingly attachable to the first sealed housing, the second sealed housing further comprising a filter disposed therein, a third sealed housing sealingly attachable to the second sealed housing, the third sealed housing having attached thereto a compressor, and an outlet pipe sealingly attachable to the third sealed housing at an end thereof and terminating in the gasoline storage tank.

4 Claims, 1 Drawing Sheet

VAPOR RECOVERY SYSTEM

BACKGROUND OF THE INVENTION

1. Field of the Invention

The present invention relates to vapor recovery systems and more particularly pertains to a new Vapor Recovery System for recovering gasoline vapors released into the vicinity of a automotive filing installation.

2. Description of the Prior Art

The use of vapor recovery systems is known in the prior art. More specifically, vapor recovery systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art vapor recovery systems include U.S. Pat. No. 5,299,605; U.S. Pat. No. 5,332,011; U.S. Pat. No. 5,040,577; U.S. Pat. No. 5,069,260; U.S. Pat. No. 4,090,539 and U.S. Pat. No. 5,390,712.

While these devices fulfill their respective, particular objectives and requirements, the aforementioned patents do not disclose a new Vapor Recovery System. The inventive device, for use with an automotive filing installation having a pumping column and a gasoline storage tank, includes an inlet means disposed in spaced relationship to a pumping column front portion, a first sealed housing sealingly attachable to the inlet means, the first sealed housing further comprising a motor and fan assembly disposed therein, a second sealed housing sealingly attachable to the first sealed housing, the second sealed housing further comprising a filter means disposed therein, a third sealed housing sealingly attachable to the second sealed housing, the third sealed housing having attached thereto a compressor, and an outlet means sealingly attachable to the third sealed housing at an end thereof and terminating in the gasoline storage tank.

In these respects, the Vapor Recovery System according to the present invention substantially departs from the conventional concepts and designs of the prior art, and in so doing provides an apparatus primarily developed for the purpose of recovering gasoline vapors released into the vicinity of a automotive filing installation.

SUMMARY OF THE INVENTION

In view of the foregoing disadvantages inherent in the known types of vapor recovery systems now present in the prior art, the present invention provides a new Vapor Recovery System construction wherein the same can be utilized for recovering gasoline vapors released into the vicinity of a automotive filing installation.

The general purpose of the present invention, which will be described subsequently in greater detail, is to provide a new Vapor Recovery System apparatus and method which has many of the advantages of the vapor recovery systems mentioned heretofore and many novel features that result in a new Vapor Recovery System which is not anticipated, rendered obvious, suggested, or even implied by any of the prior art vapor recovery systems, either alone or in any combination thereof.

To attain this, the present invention generally comprises an inlet means disposed in spaced relationship to a pumping column front portion, a first sealed housing sealingly attachable to the inlet means, the first sealed housing further comprising a motor and fan assembly disposed therein, a second sealed housing sealingly attachable to the first sealed housing, the second sealed housing further comprising a filter means disposed therein, a third sealed housing sealingly attachable to the second sealed housing, the third sealed housing having attached thereto a compressor, and an outlet means sealingly attachable to the third sealed housing at an end thereof and terminating in the gasoline storage tank.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Vapor Recovery System apparatus and method which has many of the advantages of the vapor recovery systems mentioned heretofore and many novel features that result in a new Vapor Recovery System which is not anticipated, rendered obvious, suggested, or even implied by any of the prior art vapor recovery systems, either alone or in any combination thereof.

It is another object of the present invention to provide a new Vapor Recovery System which may be easily and efficiently manufactured and marketed.

It is a further object of the present invention to provide a new Vapor Recovery System which is of a durable and reliable construction.

An even further object of the present invention is to provide a new Vapor Recovery System which is susceptible of a low cost of manufacture with regard to both materials and labor, and which accordingly is then susceptible of low prices of sale to the consuming public, thereby making such Vapor Recovery System economically available to the buying public.

Still yet another object of the present invention is to provide a new Vapor Recovery System which provides in the apparatuses and methods of the prior art some of the advantages thereof, while simultaneously overcoming some of the disadvantages normally associated therewith and in particular the disadvantage that the prior art systems attempt to recover the vapor through the nozzle and thereby do not recover vapors released into the atmosphere.

Still another object of the present invention is to provide a new Vapor Recovery System for recovering gasoline vapors released into the vicinity of a automotive filing installation.

Yet another object of the present invention is to provide a new Vapor Recovery System which includes an inlet means disposed in spaced relationship to a pumping column front portion, a first sealed housing sealingly attachable to the inlet means, the first sealed housing further comprising a motor and fan assembly disposed therein, a second sealed housing sealingly attachable to the first sealed housing, the second sealed housing further comprising a filter means disposed therein, a third sealed housing sealingly attachable to the second sealed housing, the third sealed housing having attached thereto a compressor, and an outlet means sealingly attachable to the third sealed housing at an end thereof and terminating in the gasoline storage tank.

Still yet another object of the present invention is to provide a new Vapor Recovery System that eliminates hazardous vapors such as benzene from the atmosphere.

Even still another object of the present invention is to provide a new Vapor Recovery System that reduces the risk of illness from exposure to volatile hydrocarbons.

Still yet another object of the present invention is to provide a new Vapor Recovery System that is capable of operating twenty four hours per day.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
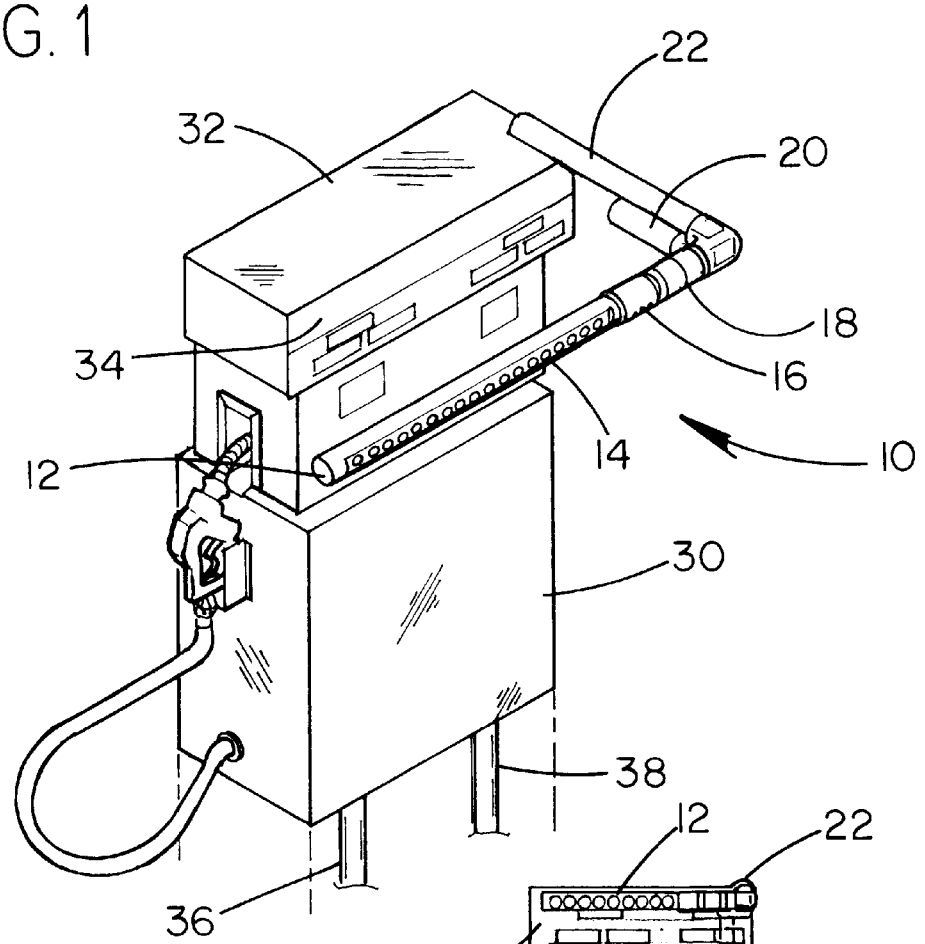
FIG. 1 is a left side perspective view of a new Vapor Recovery System according to the present invention.
Figure 2:
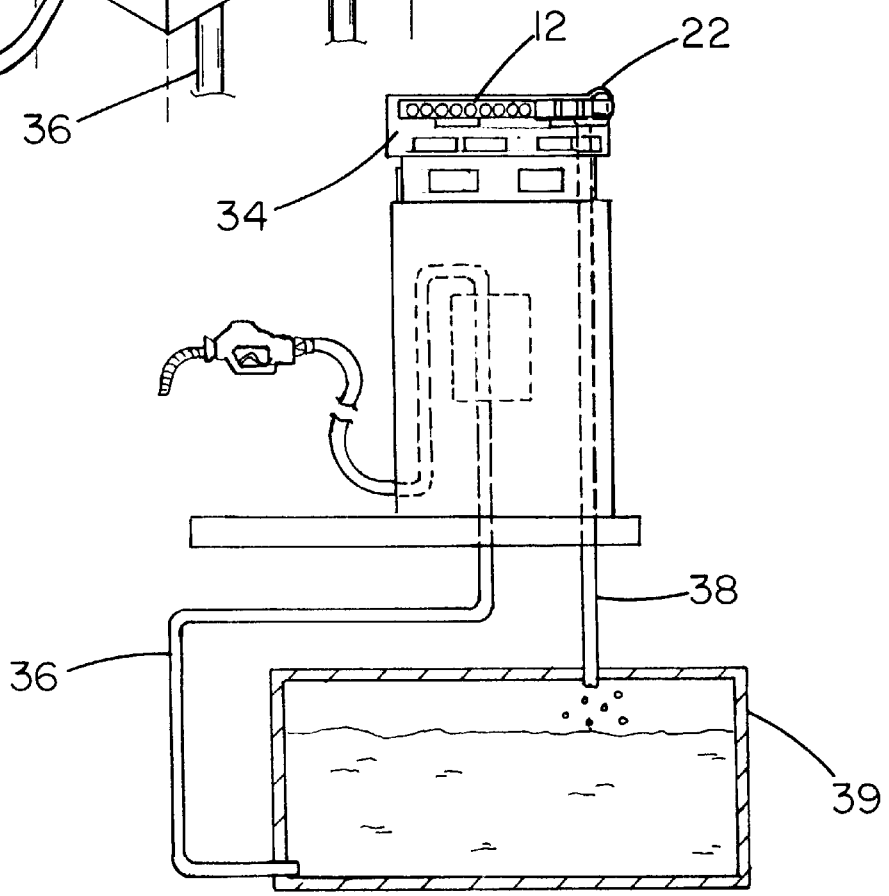
FIG. 2 is a side elevation view thereof.

With reference now to the drawings, and in particular to FIGS. 1 and 2 thereof, a new Vapor Recovery System embodying the principles and concepts of the present invention and generally designated by the reference numeral 10 will be described.

More specifically, it will be noted that the Vapor Recovery System 10 comprises an inlet means disposed in spaced relationship to a pumping column front portion 34, a first sealed housing 16 sealingly attachable to the inlet means, the first sealed housing 16 further comprising a motor and fan assembly disposed therein, a second sealed housing 18 sealingly attachable to the first sealed housing 16, the second sealed housing 18 further comprising a filter means disposed therein, a third sealed housing 22 sealingly attachable to the second sealed housing 18, the third sealed housing 22 having attached thereto a compressor 20, and an outlet means sealingly attachable to the third sealed housing 22 at an end thereof and terminating in the gasoline storage tank 39.

With reference to FIGS. 1 and 2 there is shown an automotive filling installation including a pumping column 30 having a top portion 32 and a front portion 34. The pumping column 30 is of the usual configuration known in the prior art and includes a supply pipe 36 in fluid flow communication with a gasoline storage tank 39.

The inlet means of the present invention includes a closed-ended pipe 12 having a plurality of apertures 14 formed therealong. The closed-ended pipe 12 is shown extending in spaced relationship to the front portion 34 of the pumping column 30. The first sealed housing 16 is shown sealingly attached to an end of the closed-ended pipe 12 and includes disposed therein a fan and motor assembly for drawing the air-vapor mixture through the apertures 14 into the closed-ended pipe 12 first sealed housing 16.

The second sealed housing 18 is shown sealingly attached to the first sealed housing 16 and includes disposed therein a filter means including a particulate filter. The third sealed housing 22 is shown sealingly attached to the second sealed housing 18 and extending at right angles toward the pumping column 30. The third sealed housing 22 is shown having a compressor 20 attached thereto for compressing the air-vapor mixture as it enters the third sealed housing 22. An outlet means including a return pipe 38 is shown sealingly attached to the third sealed housing 22 for returning the compressed air-vapor mixture to the gasoline storage tank 39.

In use, the motor and fan assembly, as well as the compressor, are run continuously and thereby any existent air-vapor mixture in the vicinity of the pumping column 30 is drawn through the apertures 14 into the closed-ended pipe 12. The air-vapor mixture is then forced through the particulate filter and into the third sealed housing 22 where it is compressed by compressor 20 and returned to the gasoline storage tank 39 through the return pipe 38.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Vapor Recovery System for use with an automotive filing installation having a pumping column and a gasoline storage tank comprising:

an inlet means disposed in spaced relationship to a pumping column front portion;

a first sealed housing sealingly attachable to the inlet means, the first sealed housing further comprising a motor and fan assembly disposed therein;

a second sealed housing sealingly attachable to the first sealed housing, the second sealed housing further comprising a filter means disposed therein;

a third sealed housing sealingly attachable to the second sealed housing, the third sealed housing having attached thereto a compressor;

an outlet means sealingly attachable to the third sealed housing at an end thereof, the outlet means adapted to terminate in the gasoline storage tank; and wherein an air-vapor mixture is drawn through the inlet means to the first sealed housing by means of the motor and fan assembly, filtered by the filter means, compressed by the compressor and returned to the gasoline storage tank through the outlet means.

2. The Vapor Recovery System of claim 1, wherein the inlet means further comprises a closed-ended pipe having a plurality of apertures formed therealong.

3. The Vapor Recovery System of claim 1, wherein the filter means further comprise a particulate filter.

4. The Vapor Recovery System of claim 1, wherein the motor and fan assembly and compressor are continuously operable.

* * * * *